US012324550B2

(12) United States Patent
Tramontina et al.

(10) Patent No.: US 12,324,550 B2
(45) Date of Patent: Jun. 10, 2025

(54) DISPENSING DEVICE WITH IMPROVED MOTOR ASSEMBLY

(71) Applicant: Kimberly-Clark Worldwide, Inc., Neenah, WI (US)

(72) Inventors: Paul F. Tramontina, Harleysville, PA (US); Charles Osborne, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 18/702,198

(22) PCT Filed: Nov. 23, 2021

(86) PCT No.: PCT/US2021/060564
§ 371 (c)(1),
(2) Date: Apr. 17, 2024

(87) PCT Pub. No.: WO2023/096629
PCT Pub. Date: Jun. 1, 2023

(65) Prior Publication Data

US 2024/0415335 A1 Dec. 19, 2024

(51) Int. Cl.
*A47K 5/12* (2006.01)
*A47K 5/13* (2006.01)

(52) U.S. Cl.
CPC ..... *A47K 5/1207* (2013.01); *A47K 5/12* (2013.01); *A47K 5/1217* (2013.01); *A47K 5/13* (2013.01)

(58) Field of Classification Search
CPC ..... A47K 5/1217; A47K 5/1207; A47K 5/12; A47K 5/13
See application file for complete search history.

(56) References Cited

U.S. PATENT DOCUMENTS 6,131,773 A * 10/2000 Wade ..... A47K 5/1215 222/153.09
7,066,355 B2 6/2006 Lewis et al.
(Continued)

FOREIGN PATENT DOCUMENTS

CN 112155460 A 1/2021
KR 20000059615 A 10/2000
(Continued)

OTHER PUBLICATIONS

PCT Search Report Corresponding to Application No. PCT/US2021/060564 on Apr. 1, 2022.
(Continued)

*Primary Examiner* — Frederick C Nicolas
(74) *Attorney, Agent, or Firm* — Dority & Manning, P.A.

(57) ABSTRACT

A dispenser includes a housing having an interior volume configured for receipt of a removable liquid reservoir. A mounting body is disposed within the housing. The mounting body defines a passage extending along a vertical direction between an inlet and an outlet. The passage is configured for receipt of a spout of the removable liquid reservoir at the inlet of the passage. A latch is coupled to the mounting body at the passage. The latch is configured for selectively engaging the spout of the removable liquid reservoir within the passage in order to block removal of the spout of the removable liquid reservoir from the passage.

19 Claims, 9 Drawing Sheets

(56) References Cited

U.S. PATENT DOCUMENTS

| | | | | |
|---|---|---|---|---|
| 7,527,178 | B2 * | 5/2009 | Lewis | A47K 5/1217 222/105 |
| 7,621,426 | B2 | 11/2009 | Reynolds et al. | |
| 7,980,421 | B2 * | 7/2011 | Ophardt | A47K 5/1217 250/221 |
| 7,984,825 | B2 | 7/2011 | Ophardt et al. | |
| 8,002,150 | B2 | 8/2011 | Ophardt et al. | |
| 8,261,950 | B2 * | 9/2012 | Cittadino | A47K 5/1202 222/325 |
| 8,413,852 | B2 | 4/2013 | Ophardt et al. | |
| 8,622,243 | B2 * | 1/2014 | Ophardt | G01F 11/006 250/221 |
| 8,668,116 | B2 | 3/2014 | Ciavarella et al. | |
| 9,700,181 | B1 | 7/2017 | Santoro et al. | |
| 10,893,780 | B2 | 1/2021 | Ophardt et al. | |
| 2015/0053720 | A1 | 2/2015 | Wolf et al. | |

FOREIGN PATENT DOCUMENTS

| | | | |
|---|---|---|---|
| WO | WO1990012530 | A1 | 11/1990 |
| WO | WO2015070198 | A1 | 5/2015 |

OTHER PUBLICATIONS

Archiexpo, Commercial soap dispenser DJSM0039A, 4 pages, Apr. 20, 2021, https://www.archiexpo.com/prod/mediclinics-sa/product-65510-2265762.html.

* cited by examiner

DISPENSING DEVICE WITH IMPROVED MOTOR ASSEMBLY

RELATED APPLICATIONS

The present application is the national stage entry of International Patent Application No. PCT/US2021/060564 having a filing date of Nov. 23, 2021, which is incorporated herein in its entirety by reference thereto.

BACKGROUND

Washrooms in commercial and residential buildings frequently include products, such as toilet tissue, paper towels, diapers, feminine products, soap, and air fresheners. These products are typically housed in dispensers and are dispensed as needed by the user. Certain dispensers in public restrooms and the like are wall mounted units that typically include a housing or structure that is affixed to a wall. The dispensers can be opened by a maintenance person for refilling or servicing.

Known dispensers can be difficult to reload with products. Thus, a need exists for a dispenser design with features for improved loading of product for dispensing.

SUMMARY

In general, the present disclosure is directed to a dispenser. The dispenser includes a housing having an interior volume configured for receipt of a removable liquid reservoir. A mounting body is disposed within the housing. The mounting body defines a passage extending along a vertical direction between an inlet and an outlet. The passage is configured for receipt of a spout of the removable liquid reservoir at the inlet of the passage. A latch is coupled to the mounting body at the passage. The latch is configured for selectively engaging the spout of the removable liquid reservoir within the passage in order to block removal of the spout of the removable liquid reservoir from the passage.

In a first example aspect, the latch may include a collar connected to the mounting body. An inner edge of the collar may face the passage. The collar may be movable between a disengaged position and an engaged position. The inner edge of the collar may contact the spout of the removable liquid reservoir in the engaged position of the collar. The inner edge of the collar may be spaced from the spout of the removable liquid reservoir in the disengaged position of the collar. The collar may define a handle at a middle of the collar. The mounting body may also define a latch opening. The handle of the collar may be positioned at the latch opening. The collar may be manually adjustable from the engaged position to the disengaged position with the handle at the latch opening. The latch may further include a spring coupled to the collar. The spring may be configured to urge the collar towards the disengaged position of the collar. The may include a back cover and a front cover. The front cover may be movable between an open position and a closed position relative to the back cover. The front cover may contact the collar in the closed position such that the front cover positions the collar in the engaged position.

In a second example aspect, the passage may define a frusto-conical inner guide surface that is positioned between the inlet and the outlet of the passage.

In a third example aspect, the dispenser may include a switch positioned at the passage. The switch may be actuatable by the spout of the removable liquid reservoir. The dispenser may further include a dispensing mechanism operable to dispense liquid from the removable liquid reservoir. The dispensing mechanism may include a motor in communication with the switch such that the motor is inoperable when the switch is unactuated by the spout of the removable liquid reservoir.

In a fourth example aspect, the dispenser may include a dispensing mechanism operable to dispense liquid from the removable liquid reservoir. The dispensing mechanism may include a motor. A cam may be coupled to a rotor of the motor such that the motor is operable to rotate the cam. A rocker may be coupled to the cam. The rocker may have a slot. A shaft of the cam may be received within the slot. The rocker may be configured to pivot during rotation of the cam by the motor such that the rocker actuates the spout of the removable liquid reservoir. The dispenser may include a switch positioned at the passage. The switch may be actuatable by the spout of the removable liquid reservoir. The motor may be in communication with the switch such that the motor is inoperable when the switch is unactuated by the spout of the removable liquid reservoir. The dispensing mechanism may be positioned within the mounting body.

In a fifth example aspect, the outlet of the passage may be positioned at a bottom surface of the housing.

In a sixth example aspect, the housing may include a back cover and a front cover. The front cover may be movable between an open position and a closed position relative to the back cover.

Each of the example aspects recited above may be combined with one or more of the other example aspects recited above in certain embodiments. For instance, all of the six example aspects recited above, i.e., the first through sixth examples aspects, may be combined with one another in some embodiments. As another example, any combination of two, three, four, or more of the six example aspects recited above may be combined in other embodiments. Thus, the example aspects recited above may be utilized in combination with one another in some example embodiments. Alternatively, the example aspects recited above may be individually implemented in other example embodiments. Accordingly, it will be understood that various example embodiments may be realized utilizing the example aspects recited above.

Other features and aspects of the present disclosure are discussed in greater detail below.

BRIEF DESCRIPTION OF THE DRAWINGS

A full and enabling disclosure of the present disclosure is set forth more particularly in the remainder of the specification, including reference to the accompanying figures, in which.

Figure 1:
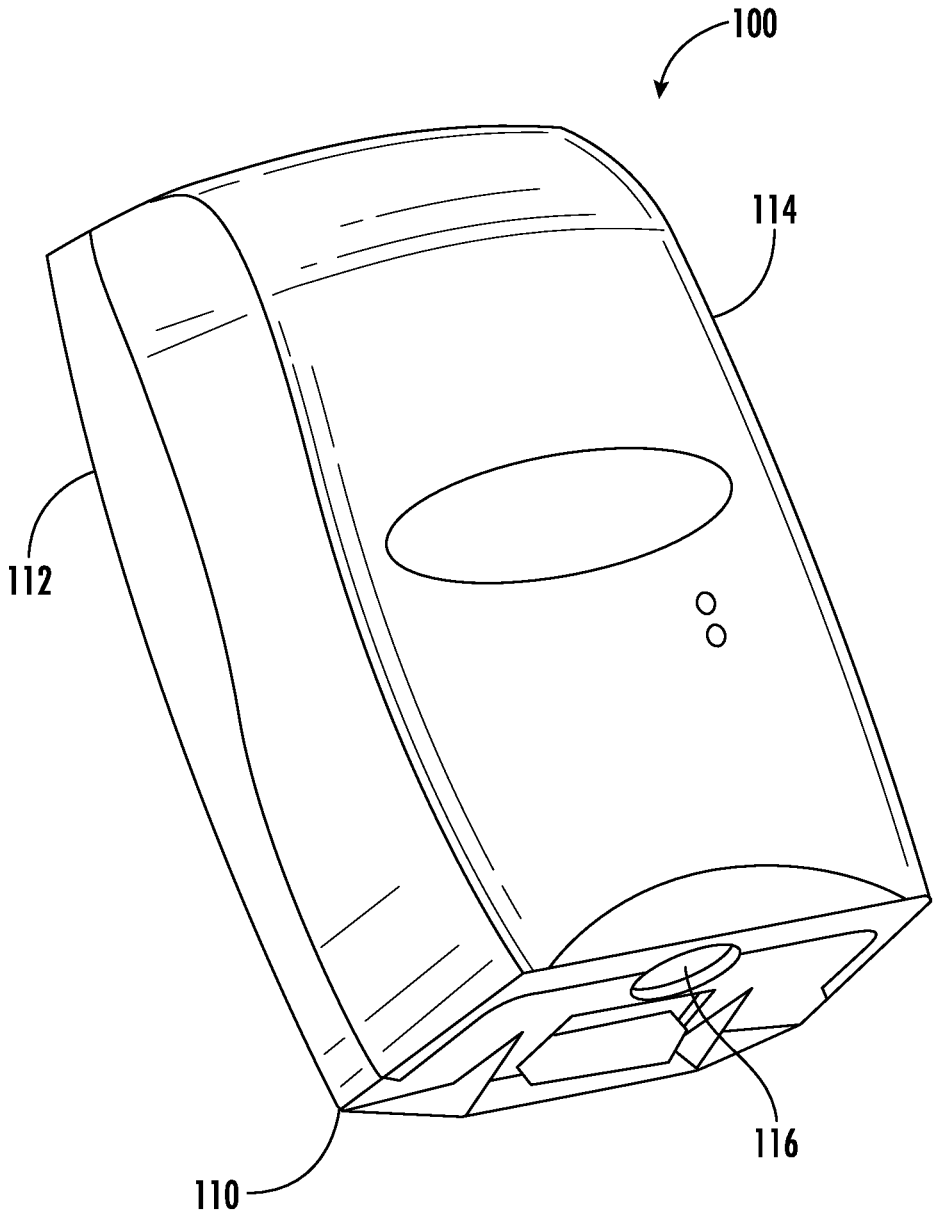
FIG. 1 is a front, perspective view of a dispenser according to an example embodiment of the present subject matter.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present disclosure.

As used herein, the terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a ten percent (10%) margin.

Figure 2:
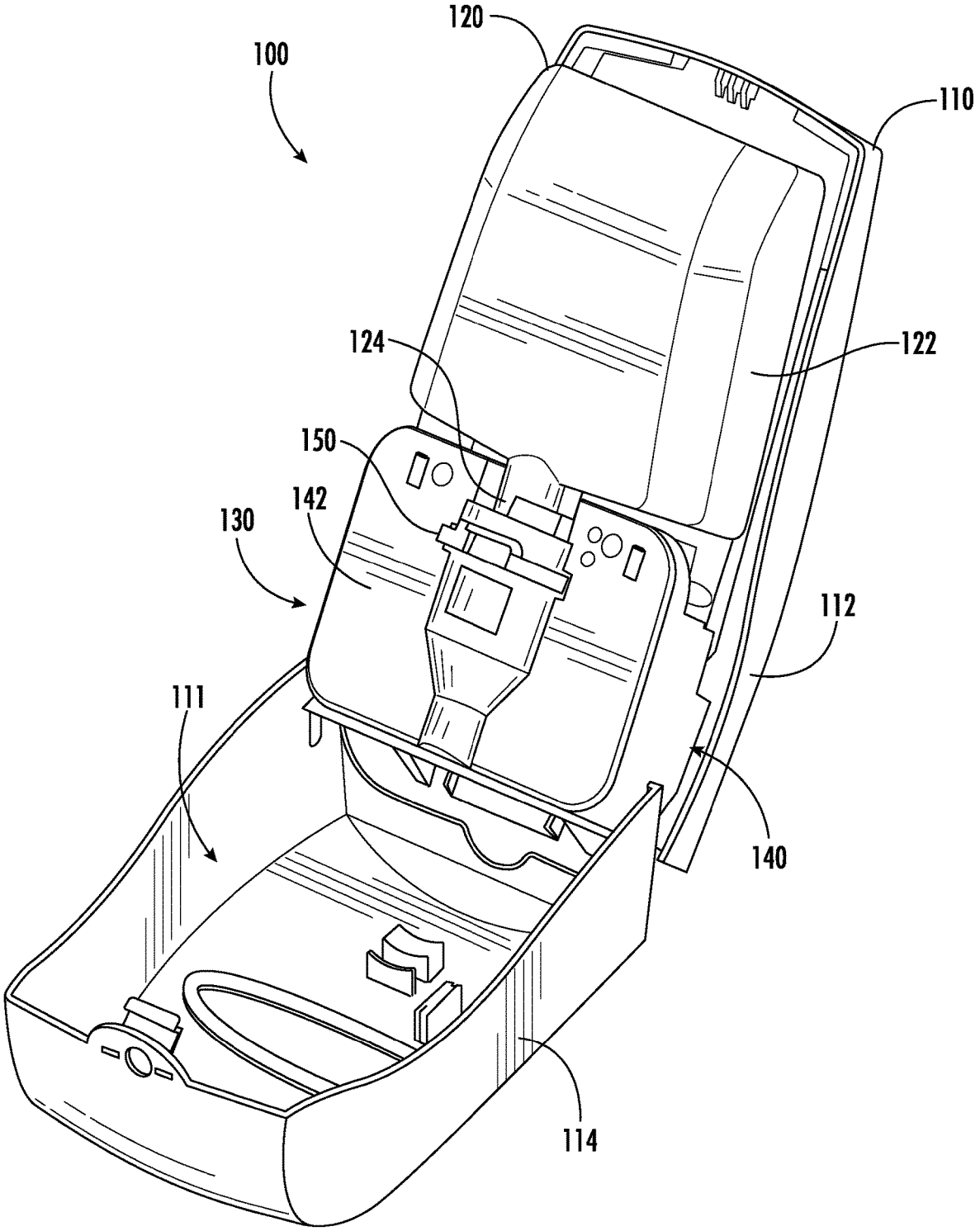
FIG. 2 is a front, perspective view of the example dispenser of FIG. 1 with a front cover shown in an open position.
Figure 3:
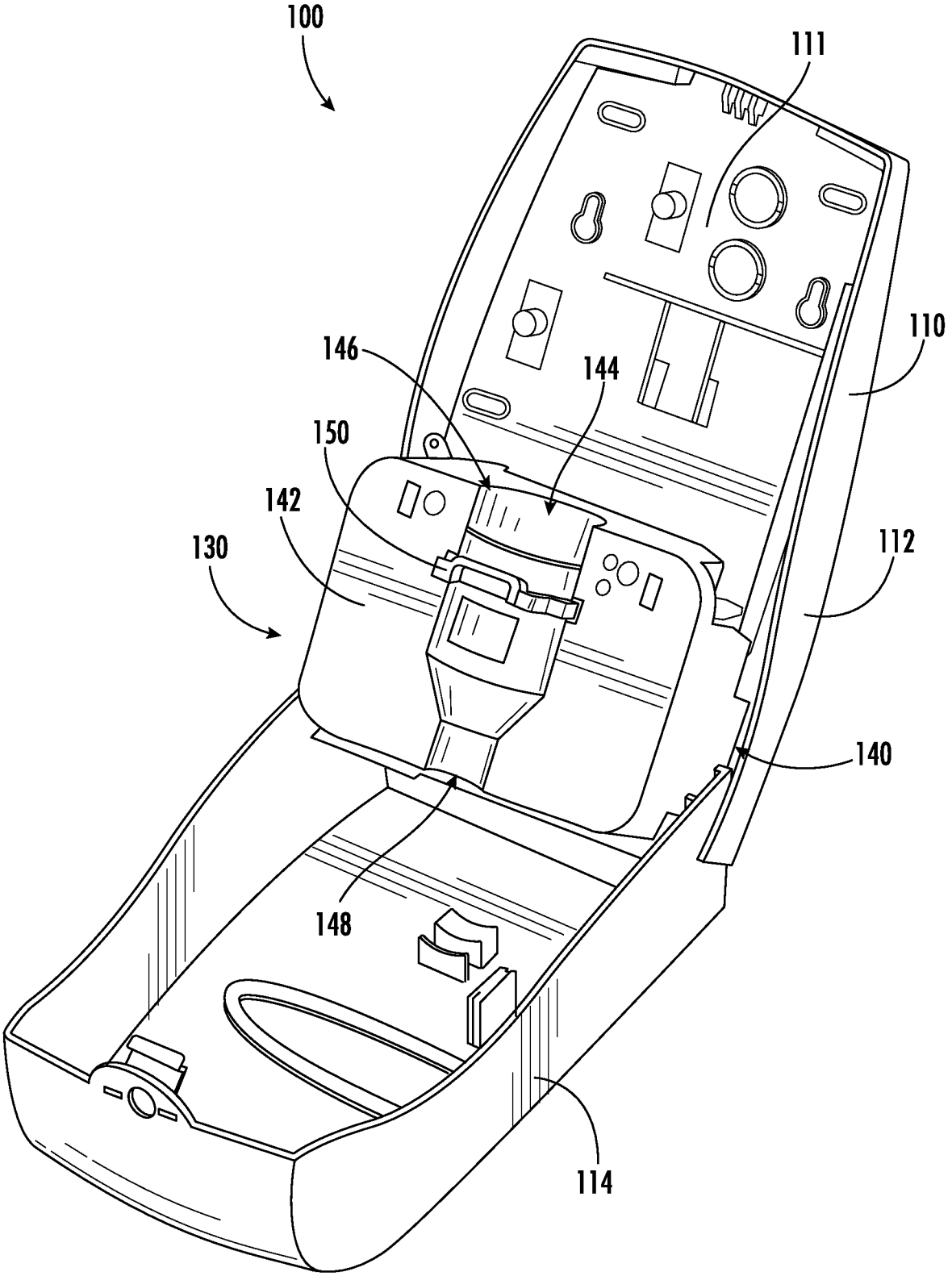
FIG. 3 is a front, perspective view of the example dispenser of FIG. 2 with a liquid reservoir removed from the dispenser.

Referring particularly to FIGS. 1 through 5, a dispenser 100 according to example aspects of the present disclosure are illustrated. As shown particularly in FIG. 1, dispenser 100 may include a housing 110. Housing 110 may have any desired overall shape. For instance, housing 110 may be a two-part configuration. Thus, e.g., housing 110 may include a back cover 112 and a front cover 114. Back cover 112 may be mounted to a structure, such as a wall, panel, mirror, cabinet, etc. For instance, back cover 112 may be fastened or adhered to such structure. Front cover 114 may be pivotally mounted to back cover 112, e.g., by a hinge or other suitable mechanism. Alternatively, front cover 114 may be completely separable from back cover 112. Front cover 114 may be moveable from a closed position as shown in FIG. 1 to an open position as shown in FIGS. 2 and 3. Housing 110 may be loaded with product from a front of housing 110 when front cover 114 is in the open position. Dispenser 100 may also include a conventional locking mechanism for securing the front cover 114 to the back cover 112 in the closed position.

Figure 4:
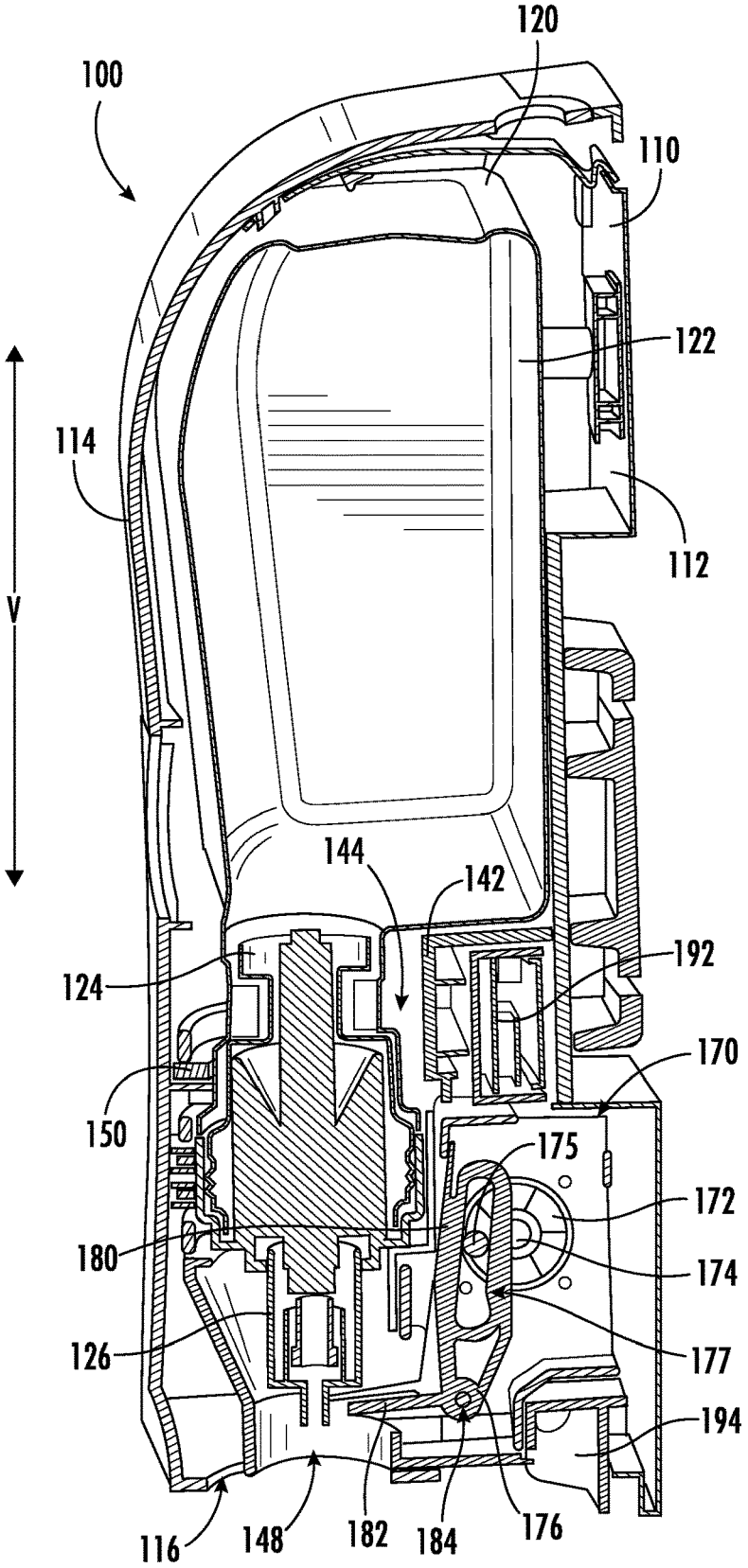
FIG. 4 is a side, section view of the example dispenser of FIG. 2.
Figure 5:
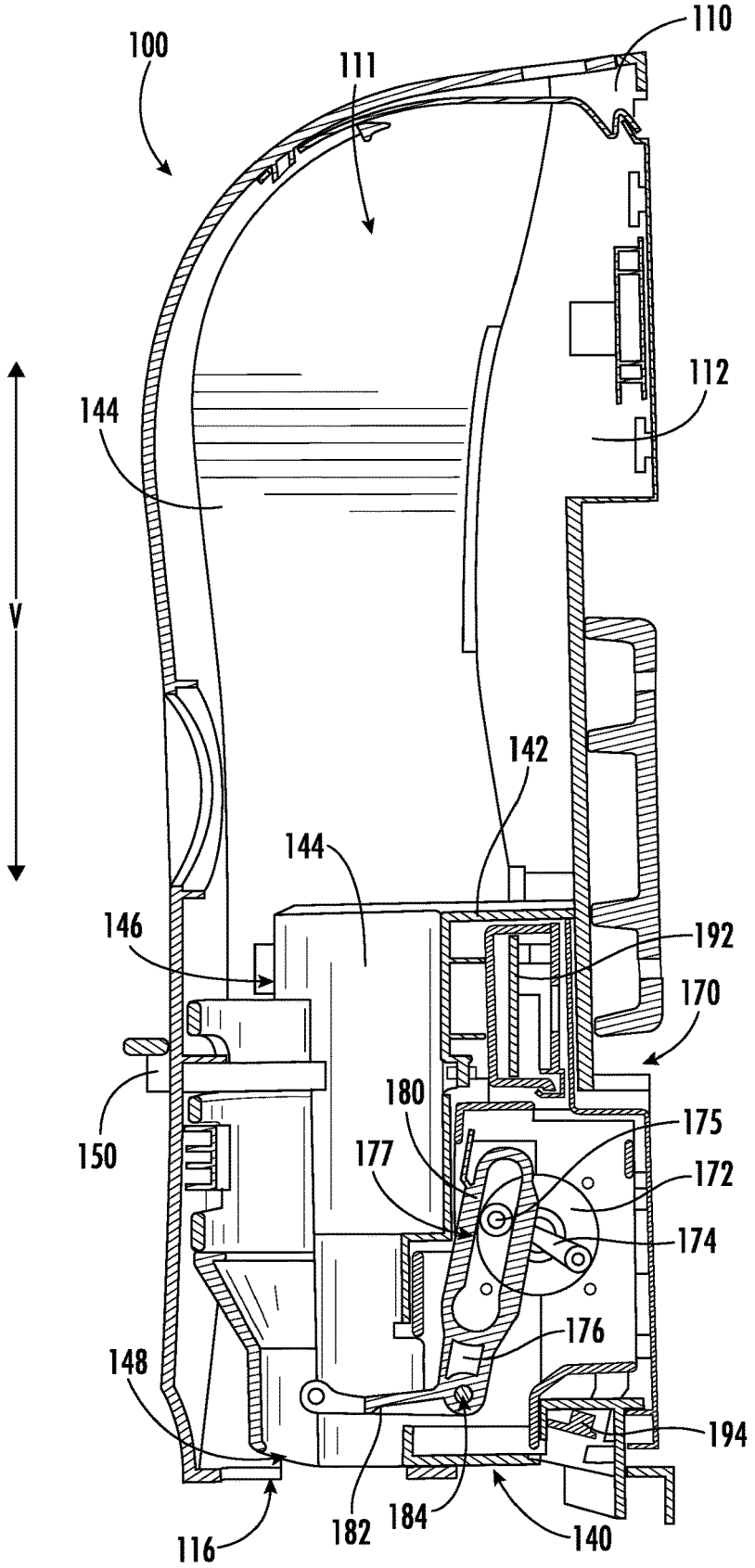
FIG. 5 is a side, section view of the example dispenser of FIG. 3.
Figure 6:
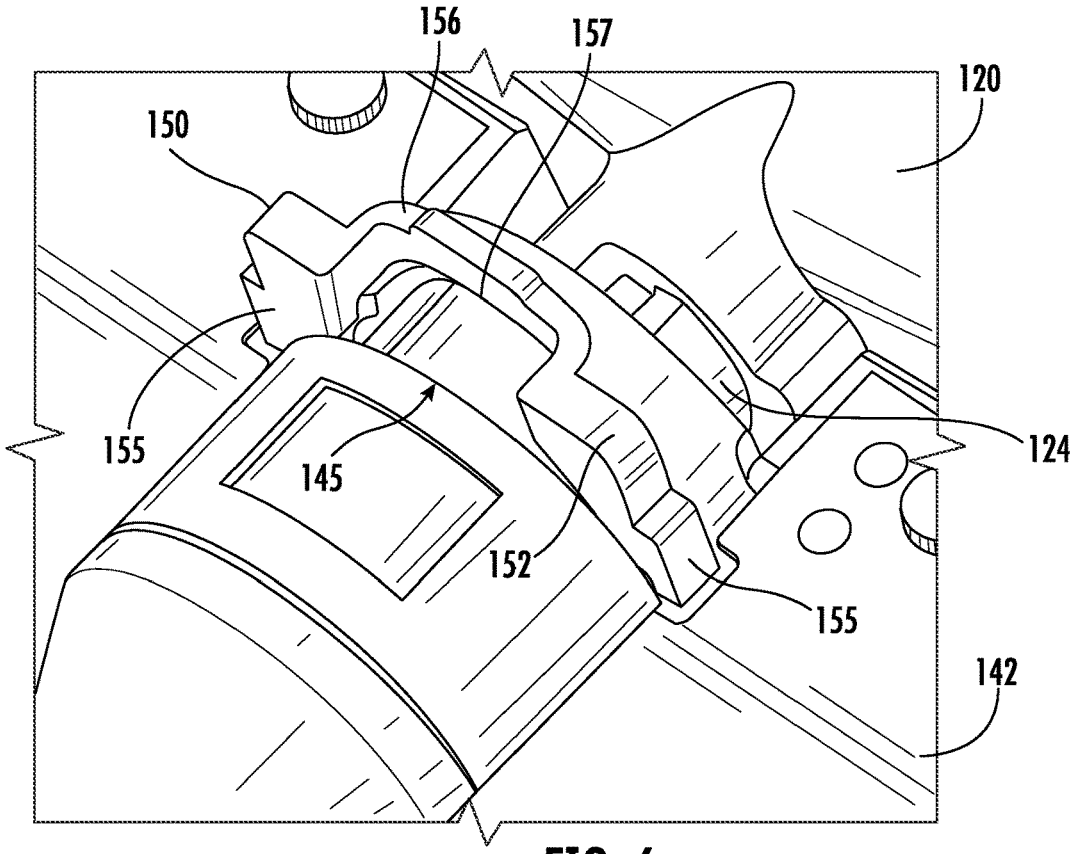
FIG. 6 is a perspective view of a latch and a mounting body of the example dispenser of FIG. 2.
Figure 7:
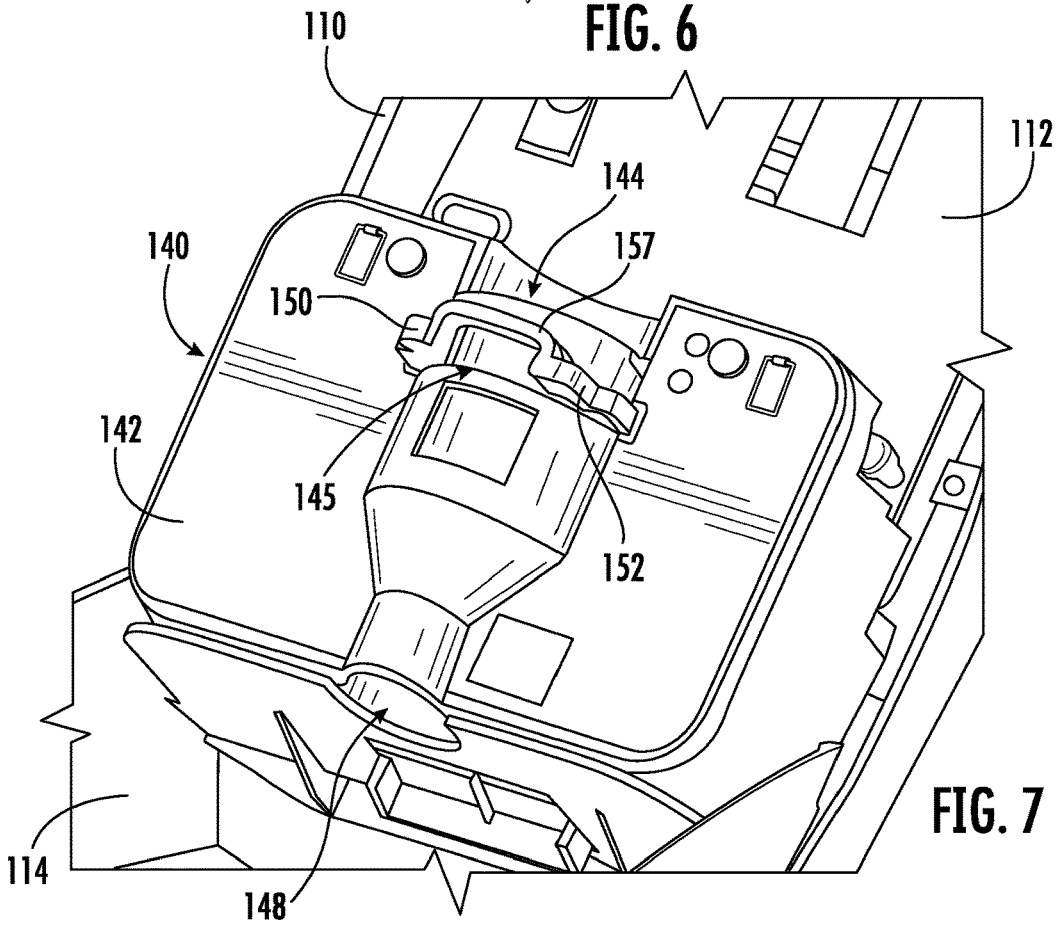
FIG. 7 is a perspective view of the latch and the mounting body of the example dispenser of FIG. 3.
Figure 8:
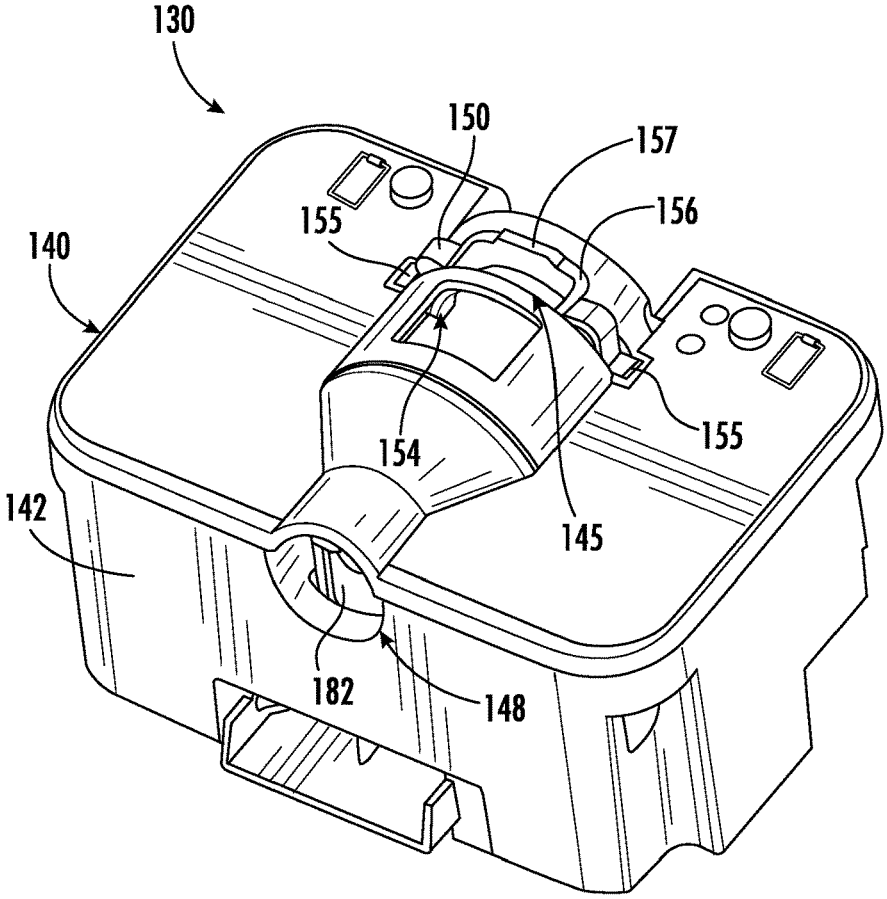
FIGS. 8 and 9 are perspective view of the latch and the mounting body of FIG. 7.
Figure 9:
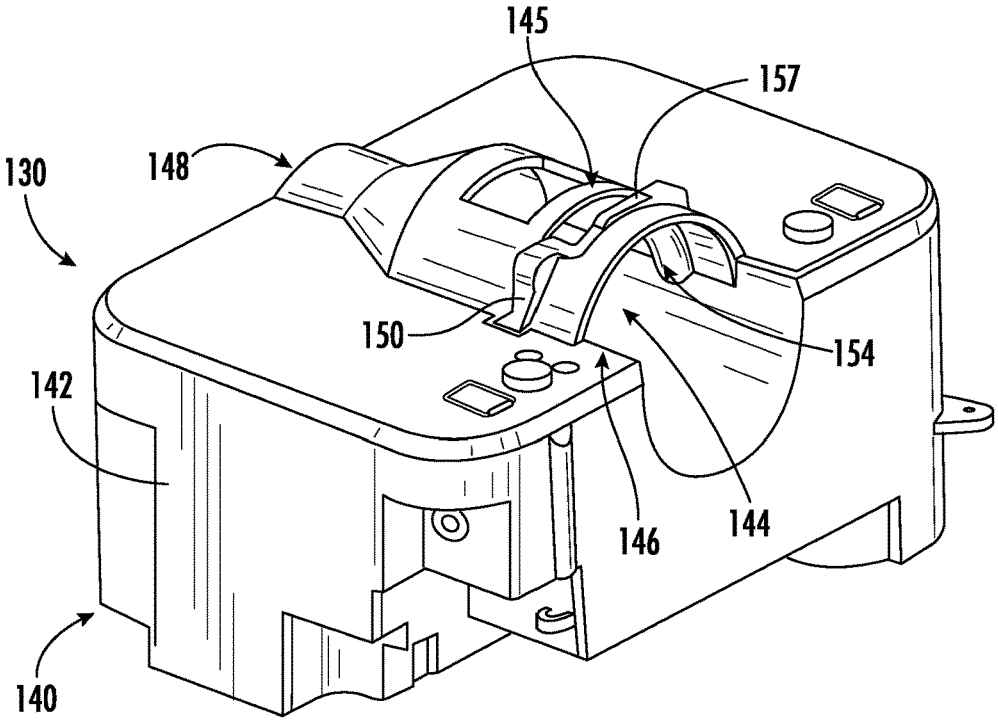

As discussed in greater detail below, dispenser 100 may include features for selectively securing a liquid reservoir 120 within housing 110 and/or facilitating installation of liquid reservoir 120 within housing 110. With reference to FIGS. 2 and 4, liquid reservoir 120 may be installed within housing 110. For instance, housing 110 may define an interior volume 111, which is sized for receipt of liquid reservoir 120 such that liquid reservoir 120 may be installed within housing 110 at interior volume 111. As shown in FIGS. 4 and 5, liquid reservoir 120 may be removed from housing 110. Thus, e.g., liquid reservoir 120 is selectively mountable within housing 110. For instance, a maintenance person may refill dispenser 100 by removing an empty liquid reservoir 120 from housing 110 and then install a fresh liquid reservoir 120 in housing 110. As noted above, housing 110 may be loaded with product from a front of housing 110. Thus, e.g., maintenance person may adjust front cover 114 to the open position in order to remove an empty liquid reservoir 120 from housing 110 and then install a fresh liquid reservoir 120 in housing 110.

Liquid reservoir 120 may be configured for containing a volume of product, such as soap, within a bladder 122. Bladder 122 may be constructed of or with a deformable, e.g., plastic, film. Bladder 122 may be sized to contain a suitable volume of product. For instance, bladder 122 may be sized to contain no less than a half-liter (0.5 L) of product, no less than one liter (1 L) of product, no less than two liters (2 L) of product, etc. Thus, bladder 122 may sized to contain a volume of product sufficient for a multitude of dispenses or uses of the product. The product within bladder 122 may exit liquid reservoir 120 at a spout 124. Spout 124 may be positioned at a bottom portion of bladder 122. Thus, product within bladder 122 may be urged by gravity out of bladder 122 through spout 124. Spout 124 may include a valve 126 for regulating the flow of product out of bladder 122 through spout 124. A length of spout 124, e.g., along the vertical direction V, may be no less than twenty-five millimeters (25 mm) and no great than one hundred and fifty millimeters (150 mm) in certain example embodiment.

As discussed in greater detail below, dispenser 100 is operable to dispense product from liquid reservoir 120 out of housing 110. For instance, housing 110 may define an opening 116 through which product (e.g., soap) may be dispensed out of housing 110. Opening 116 may be positioned a bottom surface of housing 110.

Operational components of dispenser 100 may be mounted directly to back cover 112 or may be part of a module (e.g., a component module 130 (FIGS. 2 and 3) that is received within the housing 110. For example, the operational components may be part of a module that may be removable from housing 110 for servicing and/or replacing components without the necessity of having to remove dispenser 100 (e.g., back cover 112) from a support surface. The operational components may include a support structure 140 for selectively mounting liquid reservoir 120 and other components of dispenser 100 within housing 110 and a dispensing mechanism 170 operable to dispense product from liquid reservoir 120.

Support structure 140 may include a mounting body 142. Mounting body 142 may be disposed within housing 110. For instance, mounting body 142 may be mounted to back cover 112 within interior volume 111 of housing 110. Mounting body 142 may be configured for supporting liquid reservoir 120 within housing 110. Moreover, mounting body 142 may define a passage 144. Spout 124 of liquid reservoir 120 may be positioned within passage 144 when liquid reservoir 120 is mounted to dispenser 100 within housing 110. Passage 144 may extend, e.g., along a vertical direction V, between an inlet 146 and an outlet 148. Inlet 146 of passage 144 may be positioned above outlet 148 of passage 144, e.g., along the vertical direction V. Thus, passage 144 may be vertically oriented. To install liquid reservoir 120 within housing 110, a maintenance person may insert spout 124 of liquid reservoir 120 into passage 144 at inlet 146 of passage 144 and slide spout 124 into passage 144. Mounting body 142 may enclose spout 124 of liquid reservoir 120, e.g., in a plane that is perpendicular to the vertical direction V. Moreover, mounting body 142 may obstruct or limit movement of spout 124, e.g., perpendicular to the vertical direction V, when spout 124 of liquid reservoir 120 is disposed within passage 144.

Figure 10:
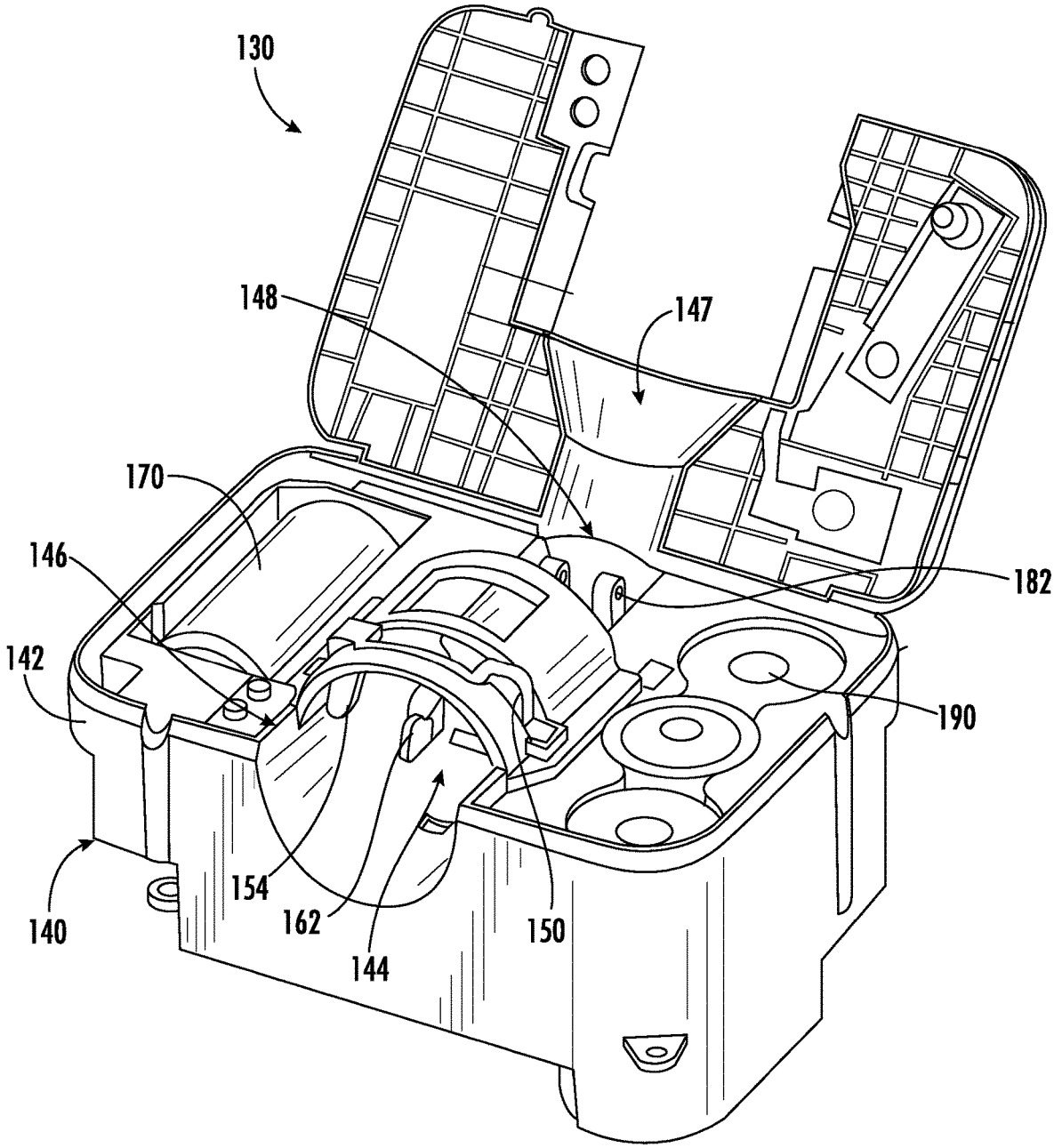
FIG. 10 is a perspective view of the mounting body of FIG. 7 with a door of the mounting body shown in an open position.

Passage 144 may define a frusto-conical inner guide surface 147 (FIG. 10). Frusto-conical inner guide surface 147 may be positioned between inlet 146 and outlet 148 of passage 144. Frusto-conical inner guide surface 147 may assist with guiding or funneling spout 124 of liquid reservoir 120 through passage 144 towards outlet 148. Outlet 148 of passage 144 may be positioned at or adjacent the bottom surface of housing 110.

A latch 150 may be coupled to mounting body 142. In addition, latch 150 may be positioned at passage 144. Latch 150 may be configured for selectively engaging spout 124 of liquid reservoir 120 within passage 144. In particular, latch 150 may block or prevent removal of spout 124 of liquid reservoir 120 from passage 144, e.g., when latch 150 engages spout 124 of liquid reservoir 120 within passage 144. A maintenance person may then adjust latch 150, e.g., such that latch 150 is not engaged with spout 124 of liquid reservoir 120 within passage 144, to allow removal of spout 124 from passage 144.

As shown in FIGS. 6 through 9, latch 150 may include a collar 152 connected to mounting body 142. For example, collar 152 may be slidably mounted on mounting body 142. An inner edge 154 of collar 152 may face passage 144. Collar 152 may be movable between a disengaged position and an engaged position. Inner edge 154 of collar 152 may contact and engage spout 124 of liquid reservoir 120 in the engaged position of collar 152. In certain example embodiments, inner edge 154 of collar 152 may be received within or against a flange on spout 124 in the engaged position. Thus, collar 152 may block or prevent removal of spout 124 of liquid reservoir 120 from passage 144 in the engaged position. Inner edge 154 of collar 152 may be spaced from and not contact spout 124 of liquid reservoir 120 in the disengaged position of the collar. Thus, collar 152 may allow removal of spout 124 of liquid reservoir 120 from passage 144 in the disengaged position.

Collar 152 may be U-shaped, e.g., when viewed along the vertical direction V, in certain example embodiments. For instance, collar 152 may include a pair of side legs 155 and a middle leg 156. Side legs 155 may be spaced apart and oriented parallel to each other, and middle leg 156 may extend between and connect side legs 155. Collar 152 may define a handle 157 at a middle of collar 152. For instance, handle 157 may be formed by middle leg 156. Mounting body 142 may define a latch opening 145, e.g., that is contiguous with passage 144. Handle 157 may be positioned at latch opening 145. Collar 152 may be manually adjustable from the engaged position to the disengaged position with handle 157 at latch opening 145. For example, a maintenance person may hook a finger onto handle 157 and pull outwardly on collar 152 to slide collar 152 from the engaged position to disengaged position.

Latch 150 may also include a spring 158 (shown schematically in FIG. 11), such as a torsion spring or coil spring. Spring 158 may be coupled to collar 152. Spring 158 may be configured to urge collar 152 towards the disengaged position. Thus, collar 152 may be normally positioned at the disengaged position, e.g., by spring 158. In such example embodiments, front cover 114 may impact against and move collar 152 from the normal, disengaged position to the engaged position. Thus, collar 152 may move from the engaged position to the disengaged position due to spring 158 when a maintenance person opens front cover 114, and collar 152 may move from the disengaged position to the engaged due to front cover 114 impacting against collar 152 when the maintenance person closes front cover 114. It will be understood that in alternative example embodiments, spring 158 may be configured to urge collar 152 towards the engaged position, e.g., such that collar 152 may be normally positioned at the engaged position by spring 158. A maintenance person may pull on handle 157 to overcome the force of spring 158 and move collar 152 from the normal, engaged position to the disengaged position in such example embodiments.

Figure 11:
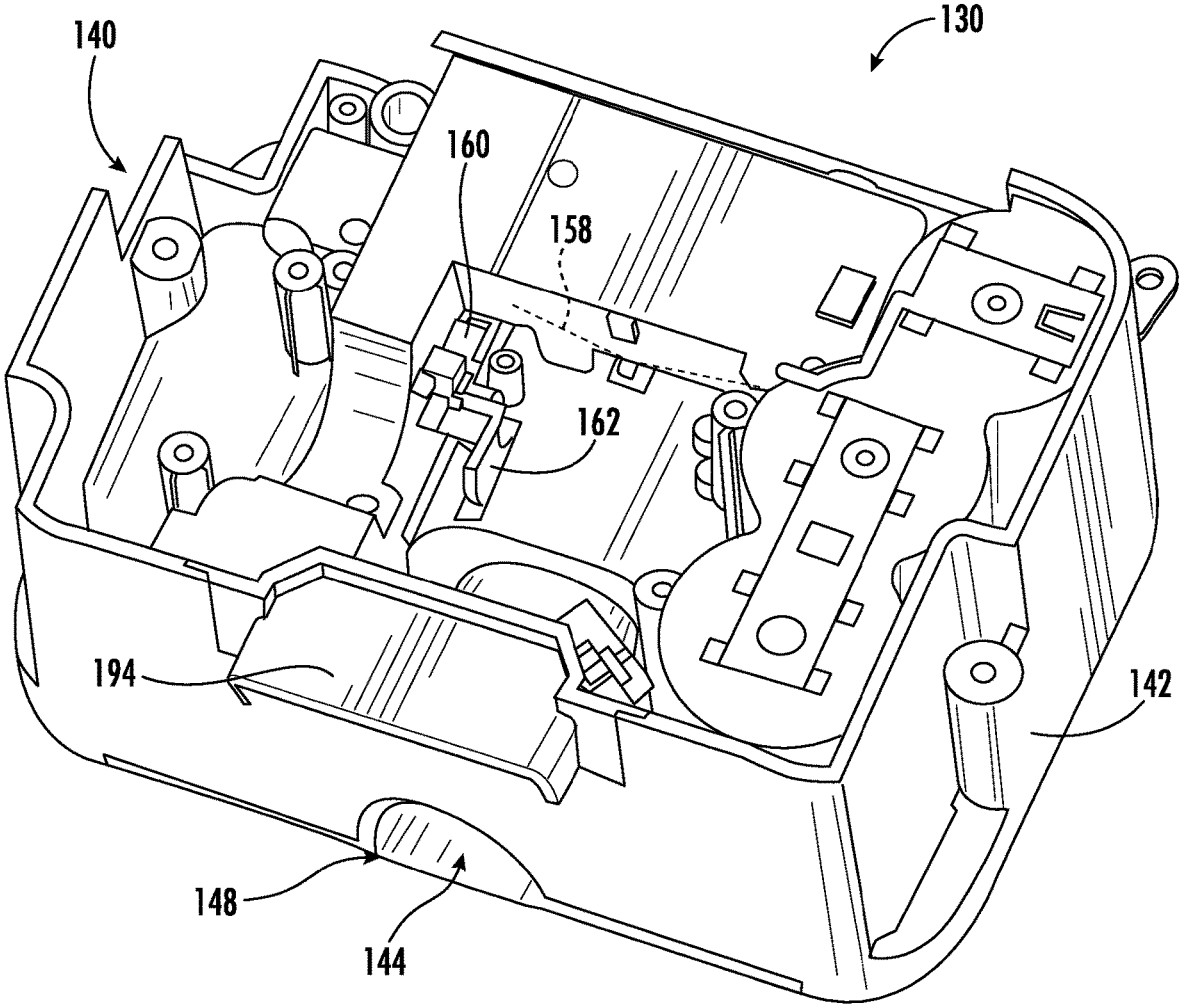
FIG. 11 is a rear, perspective view of the mounting body of FIG. 7.

With reference to FIGS. 10 and 11, a switch 160 (FIG. 11) may be positioned at passage 144. Switch 160 may be actuatable by spout 124 of liquid reservoir 120. Moreover, when spout 124 of liquid reservoir 120 is positioned within passage 144, spout 124 may actuate switch 160. Switch 160 may include a leg 162 that extends through mounting body 142 into passage 144. Leg 162 may be biased outwardly, e.g., by a spring, into passage 144. Leg 162 of switch 160 may engage spout 124 of liquid reservoir 120 as a maintenance person inserts spout 124 into passage 144, e.g., such that leg 162 deflects inwardly.

As noted above, dispensing mechanism 170 may be operable to dispense product from liquid reservoir 120. With reference to FIGS. 4, 5, and 10, dispensing mechanism 170 may include a motor 172. Motor 172 may be a brushless motor in certain example embodiments. Motor 172 may be connected to mounting body 142. Moreover, a stator of motor 172 may fixed relative to mounting body 142. A cam 174 may be coupled to a rotor of motor 172. Thus, e.g., motor 172 may be operable to rotate cam 174. Cam 174 may be press fitted or snap fitted onto the rotor of motor 172 in certain example embodiments.

A rocker 176 may be coupled to cam 174. Moreover, rocker 176 may have a slot 177, and a shaft 175 of cam 174 may be received within slot 177. Shaft 175 of cam 174 may be radially offset from an axis of rotation of cam 174 and/or the rotor of motor 172. Rocker 176 may be configured to pivot during rotation of cam 174 by motor 172 due to the movement of shaft 175 within slot 175. When rocker 176 pivots, rocker 176 may actuate spout 124, e.g., valve 126, to dispense product from liquid reservoir 120.

Rocker 176 may be pivotally coupled to mounting body 142. For example, rocker 176 may include a first arm 180 and a second arm 182. First and second arms 180, 182 may extend radially from a pivot point 184 of rocker 176. For instance, first and second arms 180, 182 may extend at different angles from pivot point 184 of rocker 176. First and second arms 180, 182 may be oriented about perpendicular to each other in certain example embodiments. Moreover, slot 177 may be defined in first arm 180, and second arm 182 may extend into passage 144. Movement of movement of shaft 175 within slot 175 may cause first and second arms 180, 182 to pivot about pivot point 184 of rocker 176.

Second arm 182 may selectively engage spout 124, e.g., valve 126, to dispense product from liquid reservoir 120. For instance, second arm 182 may actuate valve 126 during rotation of cam 174 by motor 172. Moreover, upward movement of second arm 182 within passage 144 may cause second arm 182 to open valve 126 such that product from liquid reservoir 120 exits bladder 122 at spout 124. In particular, actuation of valve 126 by rocker 176 may release a predetermined shot amount (e.g., predetermined dose) of the product from liquid reservoir 120.

Latch 150 may prevent spout 124 from lifting upwardly, e.g., along the vertical direction V, during operation of dispensing mechanism 170 and actuation of valve 126 by rocker 176. In particular, latch 150 may advantageously fix a vertical position of spout 124 within passage 144 to allow second arm 182 to engage spout 124, e.g., valve 126, and thereby dispense product from liquid reservoir 120. Thus, latch 150 may assist with dispensing of product by dispensing mechanism 170, e.g., in particular when bladder 122 is approaching an empty state.

With reference to FIGS. 10 and 11, other operational components of dispenser 100 may be disposed within component module 130 in accordance with example aspects of the present disclosure. The other operational components may include battery packs 190, printed circuit boards 192, sensors 194, sensor modules, switches, controllers or control circuitry (e.g., controllers and/or microprocessors), network enabled devices and/or chips, and combinations thereof. For example, in certain embodiments, one or more battery packs 190 configured to hold one more batteries can be included in the component module 130. For example, the battery pack 190 can be configured to hold a plurality of batteries, such as at least two batteries, such as at least three batteries, such as at least four batteries, etc. The battery pack 190 may further include any shape suitable for holding the desired sized battery. For example, in certain embodiments, the battery pack 190 may be configured to hold D-cell batteries, such as at least three D-cell batteries, such as at least four D-cell batteries. The battery pack 190 may provide structural support in order to hold the batteries in place. Furthermore, the battery pack 190 may be configured to provide electrical connections to each of the batteries, such that the batteries can provide power to other components of the dispenser 100.

In certain embodiments, one or more printed circuit boards 192 may also be disposed in the component module 130. The printed circuit boards 192 may be configured with suitable processors and/or controllers in order to operate the various components of the dispenser 100. In certain embodiments, the printed circuit boards 192 may be disposed in the component module 130 and covered or encased, so as to protect the printed circuit boards 192. For example, in the event that product leaks from liquid reservoir 120, the printed circuit boards 192 may be housed and fully encased, preventing any leaked product from accessing and/or destroying the printed circuit boards 192.

In certain embodiments, dispenser 100 may also include one or more sensors 194. Again, such sensors 194 may be at least partially housed by the mounting body 142. In one example embodiment, the sensor 194 may be an activation sensor configured to detect the presence of a user in a detection zone. Such activation sensors may include sensors configured to emit infrared light. It will be understood, however, that any activation sensor or activation system shown and/or described herein or known in the art, may be mounted in any area of housing 110, so long as the activation sensor or activation system operates as disclosed herein. In such example embodiments, the sensor 194 includes an activation sensor that is a passive sensor for detecting infrared radiation. Passive infrared detectors for incorporation into dispensers are known in the art. Generally, sensor 194 may be arranged to detect infrared radiation from a hand of a user of dispenser 100, and, upon detecting the radiation, to transmit a signal for activating the motor 172 so as to dispense an amount of the product through the 116.

It will be understood, however, that other activation mechanisms, such as capacitive and ultrasonic, may be used with the present disclosure. Capacitive proximity sensors produce an electrostatic field that will sense both metal objects and non-metallic materials such as paper, liquids, glass, and cloth. Ultrasonic proximity sensors use a transducer to send and receive high frequency sound signals. When a target enters the beam, the sound is reflected back to the sensors, causing the sensor to energize or de-energize the output circuit. Another sensor type is inductive. In this case, an electromagnetic field is used, however, detection may be limited to only metallic objects. Accordingly, once the presence of a user is detected by the activation sensor, the dispenser 100 may be configured to automatically dispense the product.

In other embodiments, the sensor(s) 194 can include one or more sensors configured to monitor operations of the dispenser 100. For example, the sensors 194 may include a sensor configured to monitor the dispensing mechanism, such as monitor the number of shot counts dispensed, the amount of product dispensed etc. In example embodiments, the sensors 194 may include a variety of functional sensors configured to monitor one or more aspects of dispenser 100 and to generate dispenser data directed thereto. Further, one or more controllers can then be configured to obtain said dispenser data from the one or more sensors 194, either directly and/or indirectly, and may further be configured to transmit data to a cloud-based management system.

For example, the one or more controllers or other control circuitry can be configured to establish a wireless connection in order to communicate dispenser data to and/or from a cloud-based management system. As an example, the dispenser 100 may be configured to establish a wireless connection with one or more controllers or processing systems capable of wirelessly transmitting data. For instance, wireless connections can be by a Bluetooth Low Energy (BLE) protocol. Wireless connections can also be established by cellular communications.

As previously noted, the dispensing mechanism 170, including motor 172, may be powered by batteries contained in a battery pack 190 or may be powered by an alternating current (AC) distribution system. If the dispenser 100 includes batteries, a sensor can also be included for determining the power level of the batteries and for providing a signal when the batteries are running low.

As described above, the dispenser 100 may include a controller and control circuitry. The controller and control circuitry may control and monitor all the functions of the dispenser 100 including the amount of product being dispensed, product usage, and any other activities that are occurring within dispenser 100. The controller may be configured to communicate information regarding the dispenser 100 to a central control system and/or a cloud-based system via wireless network means and/or through a web-based system.

In certain example embodiments, motor 172 may be in communication with switch 160. Motor 172 may be inoperable when switch 160 is unactuated by spout 124 of liquid reservoir 120. Thus, e.g., when liquid reservoir 120 is not disposed within housing 110, switch 160 may be unactuated, and motor 172 may be inoperable to rotate cam 174 and pivot rocker 176. Thus, e.g., dispensing mechanism 170 may be deactivated when switch 160 is unactuated. In such a manner, operation of dispensing mechanism 170 without liquid reservoir 120 properly installed within housing 110 may be avoided or prevented. Moreover, switch 160 may actuate each time that a maintenance person refills or services liquid reservoir 120. The controller of dispenser 100 may track the total number of dispensing operations from liquid reservoir 120 in order to estimate the remaining product within liquid reservoir 120 and notify the maintenance person when liquid reservoir 120 requires refilling or servicing. Latch 150 may prevent undesired actuation of switch 160 by preventing or blocking spout 124 from lifting upwardly, e.g., along the vertical direction V, during operation of dispensing mechanism 170 and actuation of valve 126 by rocker 176. Thus, dispenser 100 may more accurately track usage of product from liquid reservoir 120 by selectively securing spout 124 to mounting body 142.

As may be seen from the above, dispenser 100 may provide a front-loading dispenser for product, such as soap. Latch 150 may advantageously secure spout 124 of the removable liquid reservoir 120 to mounting body 142. Thus, latch 150 may prevent facilitate operation of dispensing mechanism 170 by preventing spout 124 from lifting upwardly with rocker 176. Latch 150 may also prevent undesired actuation of switch 160 and thus allow accurate tracking of dispensing of product from liquid reservoir 120.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

Example Embodiments

First example embodiment-A dispenser (100) comprising: a housing (110) having an interior volume (111) configured for receipt of a removable liquid reservoir (120); a mounting body (142) is disposed within the housing (110), the mounting body (142) defining a passage (144) extending along a vertical direction between an inlet (146) and an outlet (148), the passage (144) configured for receipt of a spout (124) of the removable liquid reservoir (120) at the inlet (146) of the passage (144); a latch (150) coupled to the mounting body (142) at the passage (144), the latch (150) configured for selectively engaging the spout (124) of the removable liquid reservoir (120) within the passage (144) in order to block removal of the spout (124) of the removable liquid reservoir (120) from the passage (144).

Second example embodiment—The dispenser (100) of the first example embodiment, wherein the latch (150) comprises a collar (152) connected to the mounting body (142), an inner edge (154) of the collar (152) facing the passage (144), the collar (152) movable between a disengaged position and an engaged position, the inner edge (154) of the collar (152) contacting the spout (124) of the removable liquid reservoir (120) in the engaged position of the collar (152), the inner edge (154) of the collar spaced from the spout (124) of the removable liquid reservoir (120) in the disengaged position of the collar (152).

Third example embodiment—The dispenser (100) of the first or second example embodiments, wherein the collar (152) defines a handle (157) at a middle of the collar (152).

Fourth example embodiment—The dispenser (100) of any one of the first through third example embodiments, wherein the mounting body (142) defines a latch opening (145), the handle (157) of the collar (152) positioned at the latch opening (145), the collar (152) manually adjustable from the engaged position to the disengaged position with the handle (157) at the latch opening (145).

Fifth example embodiment—The dispenser (100) of any one of the first through fourth example embodiments, wherein: the latch (150) further comprises a spring (158) coupled to the collar (152), the spring (158) configured to urge the collar (152) towards the disengaged position of the collar (152); the housing (110) comprises a back cover (112) and a front cover (114), the front cover (114) movable between an open position and a closed position relative to the back cover (112); and the front cover (114) contacts the collar (152) in the closed position such that the front cover (114) positions the collar (152) in the engaged position.

Sixth example embodiment—The dispenser (100) of any one of the first through fifth example embodiments, wherein the passage (144) defines a frusto-conical inner guide surface (147) that is positioned between the inlet (146) and the outlet (148) of the passage (144).

Seventh example embodiment—The dispenser (100) of any one of the first through sixth example embodiments, further comprising a switch (160) positioned at the passage (144), the switch (160) actuatable by the spout (124) of the removable liquid reservoir (120).

Eighth example embodiment—The dispenser (100) of any one of the first through seventh example embodiments, further comprising a dispensing mechanism (170) operable to dispense liquid from the removable liquid reservoir (120), the dispensing mechanism (170) comprising a motor (172) in communication with the switch (160) such that the motor (172) is inoperable when the switch (160) is unactuated by the spout (124) of the removable liquid reservoir (120).

Ninth example embodiment—The dispenser (100) of any one of the first through eighth example embodiments, further comprising a dispensing mechanism (170) operable to dispense liquid from the removable liquid reservoir (120), the dispensing mechanism (170) comprising: a motor (172); a cam (174) coupled to a rotor of the motor (172) such that the motor (172) is operable to rotate the cam (174); and a rocker (176) coupled to the cam (174), the rocker (176) having a slot (177), a shaft (175) of the cam (174) received within the slot (177), the rocker (176) configured to pivot during rotation of the cam (174) by the motor (172) such that the rocker (176) actuates the spout (124) of the removable liquid reservoir (120).

Tenth example embodiment—The dispenser (100) of any one of the first through ninth example embodiments, further comprising a switch (160) positioned at the passage (144), the switch (160) actuatable by the spout (124) of the removable liquid reservoir (120), the motor (172) in communication with the switch (160) such that the motor (172) is inoperable when the switch (160) is unactuated by the spout (124) of the removable liquid reservoir (120).

Eleventh example embodiment—The dispenser (100) of any one of the first through tenth example embodiments, wherein the dispensing mechanism (170) is positioned within the mounting body (142).

Twelfth example embodiment—The dispenser (100) of any one of the first through eleventh example embodiments, wherein the outlet (148) of the passage (144) is positioned at a bottom surface of the housing (110).

Thirteenth example embodiment—The dispenser (100) of any one of the first through twelfth example embodiments, wherein the housing (110) comprises a back cover (112) and a front cover (114), the front cover (114) movable between an open position and a closed position relative to the back cover (112).

Fourteenth example embodiment-A dispenser (100), comprising: a housing (110) having an interior volume (111) configured for receipt of a removable liquid reservoir (120); a mounting body (142) disposed within the housing (110), the mounting body (142) defining a passage (144) extending along a vertical direction between an inlet (146) and an outlet (148), the passage (144) configured for receipt of a spout (124) of the removable liquid reservoir (120) at the inlet (146) of the passage (144); a latch (150) coupled to the mounting body (142) at the passage (144), the latch (150) configured for selectively engaging the spout (124) of the removable liquid reservoir (120) within the passage (144) in order to block removal of the spout (124) of the removable liquid reservoir (120) from the passage (144); and a switch (160) positioned at the passage (144), the switch (160) actuatable by the spout (124) of the removable liquid reservoir (120), wherein the switch (160) is positioned such that the latch (150) selectively secures the removable liquid reservoir (120) within the passage (144) and the spout (124) of the removable liquid reservoir (120) actuates the switch (160).

Fifteenth example embodiment—The dispenser (100) of the fourteenth example embodiment, wherein the latch (150) comprises a collar (152) connected to the mounting body (142), an inner edge (154) of the collar (152) facing the passage (144), the collar (152) movable between a disengaged position and an engaged position, the inner edge (154) of the collar (152) contacting the spout (124) of the removable liquid reservoir (120) in the engaged position of the collar (152), the inner edge (154) of the collar (152) spaced from the spout (124) of the removable liquid reservoir (120) in the disengaged position of the collar (152).

Sixteenth example embodiment—The dispenser (100) of the fourteenth or fifteenth example embodiment, wherein the collar (152) defines a handle (157) at a middle of the collar (152).

Seventeenth example embodiment—The dispenser (100) of any one of the fourteenth through sixteenth example embodiments, wherein the mounting body (142) defines a latch opening (145), the handle (157) of the collar (152) positioned at the latch opening (145), the collar (152) manually adjustable from the engaged position to the disengaged position with the handle (157) at the latch opening (145).

Eighteenth example embodiment—The dispenser (100) of any one of the fourteenth through seventeenth example embodiments, wherein: the latch (150) further comprises a spring (158) coupled to the collar (152), the spring (158) configured to urge the collar (152) towards the disengaged position of the collar (152); the housing (110) comprises a back cover (112) and a front cover (114), the front cover (114) movable between an open position and a closed position relative to the back cover (112); and the front cover (114) contacts the collar (152) in the closed position such that the front cover (114) positions the collar (152) in the engaged position.

Nineteenth example embodiment—The dispenser (100) of any one of the fourteenth through eighteenth example embodiments, wherein the passage (144) defines a frusto-conical inner guide surface (147) that is positioned between the inlet (146) and the outlet (148) of the passage (144).

Twentieth example embodiment—The dispenser (100) of any one of the fourteenth through nineteenth example embodiments, further comprising a dispensing mechanism (170) disposed within the mounting body (142), the dispensing mechanism (170) operable to dispense liquid from the removable liquid reservoir (120), the dispensing mechanism (170) comprising: a motor (172); a cam (174) coupled to a rotor of the motor (172) such that the motor (172) is operable to rotate the cam (174); and a rocker (176) coupled to the cam (174), the rocker (176) having a slot (177), a shaft (175) of the cam (174) received within the slot (177), the rocker (176) configured to pivot during rotation of the cam (174) by the motor (172) such that the rocker (176) actuates the spout (124) of the removable liquid reservoir (120), wherein the motor (172) is in communication with the switch (160) such that the motor (172) is inoperable when the switch (160) is unactuated by the spout (124) of the removable liquid reservoir (120).

What is claimed:

1. A dispenser, comprising:

a housing having an interior volume configured for receipt of a removable liquid reservoir;

a mounting body disposed within the housing, the mounting body defining a passage extending along a vertical direction between an inlet and an outlet, the passage configured for receipt of a spout of the removable liquid reservoir at the inlet of the passage;

a latch coupled to the mounting body at the passage, the latch configured for selectively engaging the spout of the removable liquid reservoir within the passage in order to block removal of the spout of the removable liquid reservoir from the passage; and a dispensing mechanism operable to dispense liquid from the removable liquid reservoir, the dispensing mechanism comprising:

a motor;

a cam coupled to a rotor of the motor such that the motor is operable to rotate the cam; and a rocker coupled to the cam, the rocker having a slot, a shaft of the cam received within the slot, the rocker configured to pivot during rotation of the cam by the motor such that the rocker actuates the spout of the removable liquid reservoir.

2. The dispenser of claim 1, wherein the latch comprises a collar connected to the mounting body, an inner edge of the collar facing the passage, the collar movable between a disengaged position and an engaged position, the inner edge of the collar contacting the spout of the removable liquid reservoir in the engaged position of the collar, the inner edge of the collar spaced from the spout of the removable liquid reservoir in the disengaged position of the collar.

3. The dispenser of claim 2, wherein the collar defines a handle at a middle of the collar.

4. The dispenser of claim 3, wherein the mounting body defines a latch opening, the handle of the collar positioned at the latch opening, the collar manually adjustable from the engaged position to the disengaged position with the handle at the latch opening.

5. The dispenser of claim 2, wherein:

the latch further comprises a spring coupled to the collar, the spring configured to urge the collar towards the disengaged position of the collar;

the housing comprises a back cover and a front cover, the front cover movable between an open position and a closed position relative to the back cover; and the front cover contacts the collar in the closed position such that the front cover positions the collar in the engaged position.

6. The dispenser of claim 1, wherein the passage defines a frusto-conical inner guide surface that is positioned between the inlet and the outlet of the passage.

7. The dispenser of claim 1, further comprising a switch positioned at the passage, the switch actuatable by the spout of the removable liquid reservoir.

8. The dispenser of claim 7, wherein the motor is in communication with the switch such that the motor is inoperable when the switch is unactuated by the spout of the removable liquid reservoir.

9. The dispenser of claim 1, further comprising a switch positioned at the passage, the switch actuatable by the spout of the removable liquid reservoir, the motor in communication with the switch such that the motor is inoperable when the switch is unactuated by the spout of the removable liquid reservoir.

10. The dispenser of claim 1, wherein the dispensing mechanism is positioned within the mounting body.

11. The dispenser of claim 1, wherein the outlet of the passage is positioned at a bottom surface of the housing.

12. The dispenser of claim 1, wherein the housing comprises a back cover and a front cover, the front cover movable between an open position and a closed position relative to the back cover.

13. A dispenser, comprising:

a housing having an interior volume configured for receipt of a removable liquid reservoir;

a mounting body disposed within the housing, the mounting body defining a passage extending along a vertical direction between an inlet and an outlet, the passage configured for receipt of a spout of the removable liquid reservoir at the inlet of the passage;

a latch coupled to the mounting body at the passage, the latch configured for selectively engaging the spout of the removable liquid reservoir within the passage in order to block removal of the spout of the removable liquid reservoir from the passage; and a switch positioned at the passage, the switch actuatable by the spout of the removable liquid reservoir, wherein the switch is positioned such that the latch selectively secures the removable liquid reservoir within the passage and the spout of the removable liquid reservoir actuates the switch.

14. The dispenser of claim 13, wherein the latch comprises a collar connected to the mounting body, an inner edge of the collar facing the passage, the collar movable between a disengaged position and an engaged position, the inner edge of the collar contacting the spout of the removable liquid reservoir in the engaged position of the collar, the inner edge of the collar spaced from the spout of the removable liquid reservoir in the disengaged position of the collar.

15. The dispenser of claim 14, wherein the collar defines a handle at a middle of the collar.

16. The dispenser of claim 15, wherein the mounting body defines a latch opening, the handle of the collar positioned at the latch opening, the collar manually adjustable from the engaged position to the disengaged position with the handle at the latch opening.

17. The dispenser of claim 14, wherein:

the latch further comprises a spring coupled to the collar, the spring configured to urge the collar towards the disengaged position of the collar;

the housing comprises a back cover and a front cover, the front cover movable between an open position and a closed position relative to the back cover; and the front cover contacts the collar in the closed position such that the front cover positions the collar in the engaged position.

18. The dispenser of claim 13, wherein the passage defines a frusto-conical inner guide surface that is positioned between the inlet and the outlet of the passage.

19. The dispenser of claim 13, further comprising a dispensing mechanism disposed within the mounting body, the dispensing mechanism operable to dispense liquid from the removable liquid reservoir, the dispensing mechanism comprising:

a motor;

a cam coupled to a rotor of the motor such that the motor is operable to rotate the cam; and a rocker coupled to the cam, the rocker having a slot, a shaft of the cam received within the slot, the rocker configured to pivot during rotation of the cam by the motor such that the rocker actuates the spout of the removable liquid reservoir, wherein the motor is in communication with the switch such that the motor is inoperable when the switch is unactuated by the spout of the removable liquid reservoir.

* * * * *